US010806278B1

(12) United States Patent
Leach

(10) Patent No.: US 10,806,278 B1
(45) Date of Patent: Oct. 20, 2020

(54) BODY PILLOW WITH PILLOW POCKET

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 0 days.

(21) Appl. No.: 14/305,854

(22) Filed: Jun. 16, 2014

(51) Int. Cl.
*A47G 9/10* (2006.01)
*A47C 20/02* (2006.01)

(52) U.S. Cl.
CPC ..... *A47G 9/10* (2013.01); *A47C 20/025* (2013.01); *A47G 9/1045* (2013.01); *A47G 9/1072* (2013.01)

(58) Field of Classification Search
CPC ... A47C 20/021; A47C 20/023; A47C 20/025; A47C 20/027; A47G 9/10; A47G 9/1045; A47G 9/1054; A47G 9/1072; A47G 9/1081; A47G 9/109
USPC ..... 5/631, 632, 630, 636, 639, 640, 930
See application file for complete search history.

(56) References Cited

U.S. PATENT DOCUMENTS 682,871 A 9/1901 Hogan et al.
2,795,802 A 6/1957 Myers
3,003,815 A * 10/1961 Zinn ..... 297/118
3,327,330 A * 6/1967 McCullough ..... 5/640
4,173,048 A * 11/1979 Varaney ..... 5/632
4,506,396 A * 3/1985 Ritchie et al. ..... 5/631
4,834,459 A 5/1989 Leach
4,861,109 A 8/1989 Leach
4,872,228 A 10/1989 Bishop
D309,018 S 7/1990 Leach
5,103,514 A 4/1992 Leach
5,325,818 A 7/1994 Leach
5,359,739 A 11/1994 Rains et al.
5,519,906 A * 5/1996 Fanto-Chan ..... 5/631
5,729,846 A * 3/1998 Sullivan ..... 5/419
5,978,990 A * 11/1999 Akey ..... 5/632
5,987,674 A * 11/1999 Schaffner et al. ..... 5/632
6,052,848 A * 4/2000 Kelly ..... 5/632
6,081,950 A 7/2000 Selton
6,088,854 A 7/2000 Brownrigg
6,343,727 B1 2/2002 Leach
6,354,665 B1 * 3/2002 Ross ..... A47C 4/54 297/250.1
6,427,251 B1 8/2002 Leach
6,499,164 B1 12/2002 Leach
(Continued)

OTHER PUBLICATIONS

Leachco, Inc., "Back 'N Belly Contoured Body Pillow," [online] web page retrieved from http://www.leachco.com/stores.yahoo.net/backnbelly.html, Ada, OK. The exact date of publication is unknown. This document was published prior to the effective filing date of the instant application, namely, Jun. 16, 2014, and prior to any foreign priority date of the present application. [retrieved on Oct. 11, 2007].
(Continued)

*Primary Examiner* — David R Hare
(74) *Attorney, Agent, or Firm* — Mary M. Lee

(57) ABSTRACT

A generally U-shaped body pillow comprising a pillow pocket in the crown or center section. The pillow pocket in the center section is sized to removably receive a bed pillow of the user's choice. The pillow pocket is formed by a back panel that extends substantially the width of the bed pillow and a front panel that is no more than about half the width of the bed pillow. In this way, the user's head, neck and shoulders rest primarily on the bed pillow.

30 Claims, 4 Drawing Sheets

(56) References Cited

U.S. PATENT DOCUMENTS

| | | | | |
|---|---|---|---|---|
| 6,553,590 | B1 | 4/2003 | Leach | |
| 6,601,252 | B1 | 8/2003 | Leach | |
| 6,751,817 | B1 | 6/2004 | Leach | |
| 6,760,934 | B1 * | 7/2004 | Leach | 5/632 |
| 7,010,821 | B1 | 3/2006 | Leach | |
| 7,089,614 | B1 * | 8/2006 | Clapp | 5/632 |
| D530,136 | S | 10/2006 | Toth | |
| 7,114,206 | B2 * | 10/2006 | Leach | 5/632 |
| 7,127,760 | B2 | 10/2006 | Bartley et al. | |
| 7,146,663 | B2 * | 12/2006 | Brown | A47D 13/083 5/636 |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 7,657,954 | B1 | 2/2010 | Bunkers | |
| 7,676,871 | B1 | 3/2010 | Leach | |
| 7,708,342 | B2 | 5/2010 | Leach | |
| 7,788,752 | B2 * | 9/2010 | Tidwell | A47C 16/00 5/632 |
| 7,793,371 | B1 | 9/2010 | Leach | |
| 7,818,842 | B2 * | 10/2010 | Marciano | 5/694 |
| 7,878,587 | B1 | 2/2011 | Leach | |
| 7,886,381 | B2 | 2/2011 | Aiken et al. | |
| 7,926,135 | B1 | 4/2011 | Leach | |
| 7,958,582 | B1 | 6/2011 | Scamardo | |
| 8,074,310 | B1 | 12/2011 | Robbins | |
| 8,136,186 | B1 | 3/2012 | Leach | |
| 8,146,760 | B1 | 4/2012 | Leach | |
| 8,418,295 | B2 | 4/2013 | Clark | |
| 8,419,128 | B1 | 4/2013 | Leach | |
| 8,448,275 | B1 | 5/2013 | Leach | |
| 8,458,830 | B1 * | 6/2013 | Pierce et al. | 5/413 R |
| 8,468,627 | B2 | 6/2013 | Leach | |
| 8,479,334 | B1 | 7/2013 | Leach | |
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 2005/0278864 | A1 | 12/2005 | Leach | |
| 2006/0031992 | A1 | 2/2006 | Moore | |
| 2006/0288485 | A1 | 12/2006 | Fox | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0180623 | A1 | 8/2007 | Stein et al. | |
| 2007/0277321 | A1 | 12/2007 | Leach | |
| 2008/0235877 | A1 * | 10/2008 | Murray et al. | 5/640 |
| 2010/0077551 | A1 * | 4/2010 | Liu | A47G 9/10 5/636 |
| 2012/0073055 | A1 * | 3/2012 | Cupo | A47C 7/38 5/636 |
| 2013/0232691 | A1 * | 9/2013 | Saul | 5/632 |
| 2014/0000034 | A1 * | 1/2014 | Alexander | A47G 9/1081 5/636 |
| 2014/0196214 | A1 * | 7/2014 | DuPre | A47G 9/1045 5/644 |
| 2014/0215719 | A1 * | 8/2014 | Gibbons et al. | 5/632 |

OTHER PUBLICATIONS

Leachco, Inc., "Back 'N Belly Contoured Body Pillow," packaging card, 2009, Leachco, Inc., Ada, OK, USA. The exact date of publication is unknown. This document was published prior to the effective filed of the instant application, namely, Jun. 16, 2014, and prior to any foreign priority date of the present application.

* cited by examiner

BODY PILLOW WITH PILLOW POCKET

FIELD OF THE INVENTION

The present invention relates generally to body support pillows.

DETAILED DESCRIPTION OF THE PREFERRED EMBODIMENTS

Body pillows enjoy increasing popularity among consumers. While one major use is to provide back and belly support for expectant mothers, many others use body pillows for general back and leg support while sleeping or reclining. On such body pillow is shown and described in U.S. Pat. No. 6,760,934, entitled "Symmetrically Contoured Support Pillow," issued Jul. 13, 2004, and the contents this patent are incorporated herein by reference. While conventional body pillows provide much needed support and comfort, they typically do not come in the wide variety of types and firmnesses as do standard bed pillows.

For example, standard bed pillows have different filler materials, including feathers, down, polyester, gel, latex, and visco-elastic memory foam. Additionally, bed pillows may be covered in different fabrics, such as cotton, bamboo, polyesters, and blends of these materials. Still further, standard bed pillows also offer the user the option of selecting her own pillow case, which may be made of cotton, linen, silk, satin, bamboo, polyester, or blends of these materials. Heretofore, one disadvantage of using a full body pillow has been the inability to customize the head portion. The body pillow of the present invention provides a full-size body pillow with a pillow pocket at the crown or head portion. This allows the user to insert her own bed pillow of choice and to use whatever pillow case she prefers.

Figure 1:
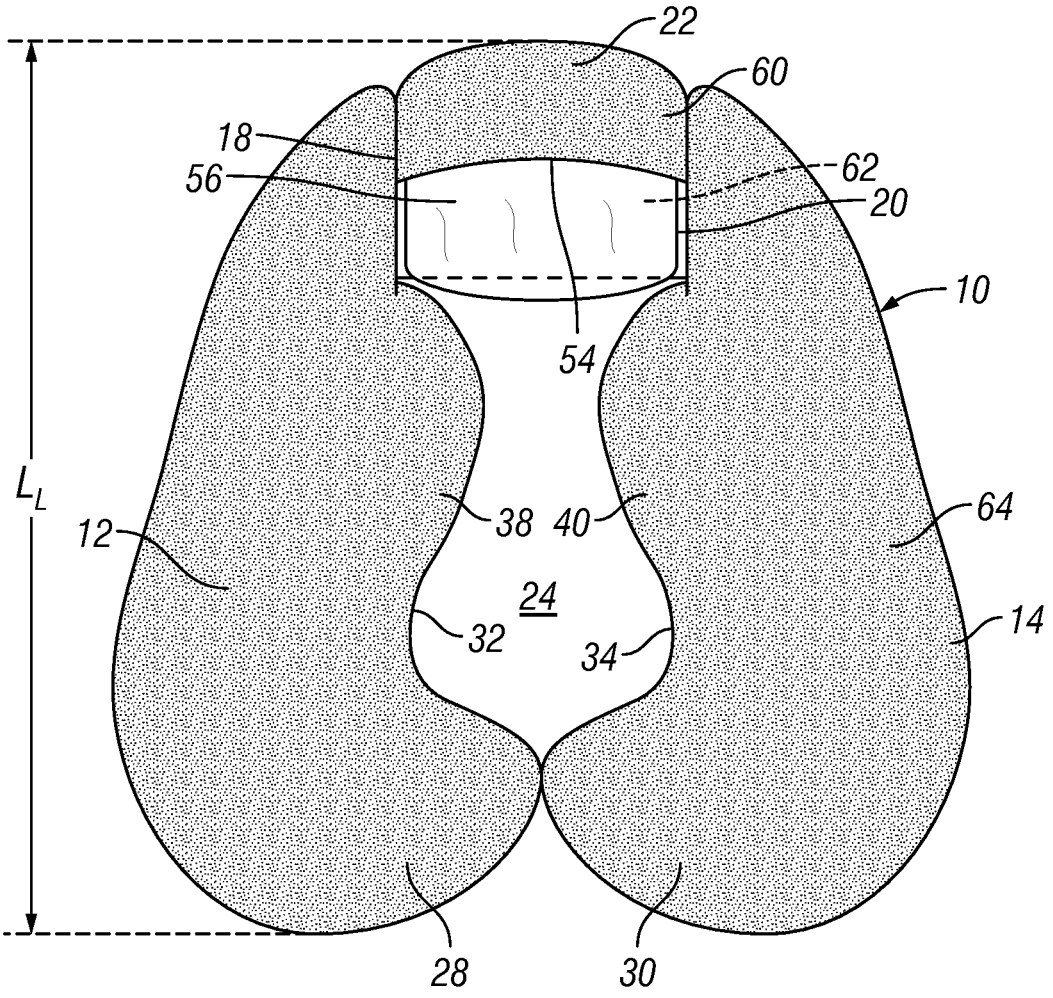
FIG. 1 is a plan view of a body pillow made in accordance with a preferred embodiment of the present invention. The body pillow is shown in its resting position with the user's bed pillow inserted in the pillow pocket.
Figure 2:
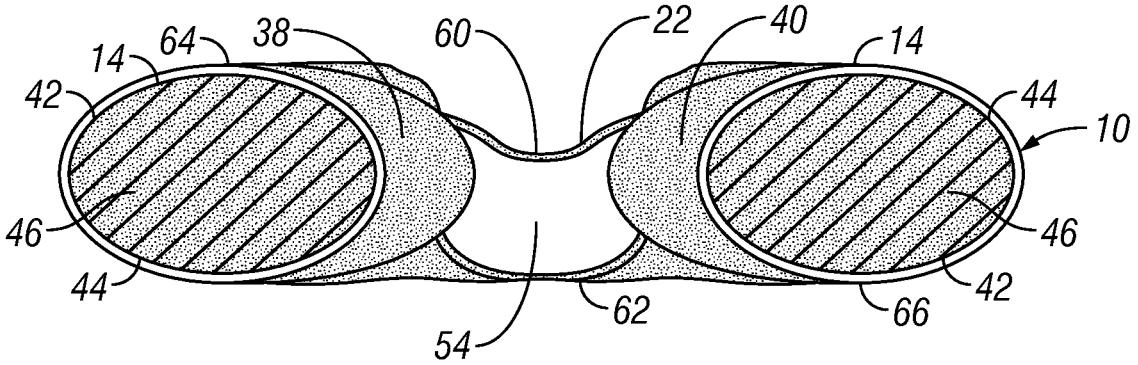
FIG. 2 is a cross-sectional view of the body pillow shown in FIG. 1

Turning now to the drawings in general and to FIGS. 1-2 in particular, there is shown therein a body pillow made in accordance with a preferred embodiment of the present invention and designated generally by the reference numeral 10. In the resting position, shown in FIGS. 1 and 2, the body pillow 10 comprises two legs 12 and 14 that extend at an angle from the first and second ends 18 and 20 of a connecting center section 22 to form a body receiving space 24. As used herein, "resting position" refers to the position and shape the pillow 10 naturally assumes when no tension or pressure is exerted on any part it.

In the resting position, the body receiving space 24 includes a generally U-shaped portion. As used herein, "U-shaped" denotes a shape comprising two legs extending in the same general direction from a common connecting portion. "U-shaped" does not require that the legs are the same length or that the legs are parallel.

In the preferred embodiment, the legs 12 and 14 are similarly and symmetrically formed and are mirror images of each other. They may be provided with inwardly turned "toe" ends 28 and 30, respectively. Additionally, each leg 12 and 14 has a length "$L_L$" and defines an inner aspect 32 and 34 partly defining the body receiving space 24. The legs 12 and 14 preferably are about the same length, and may diverge slightly from the center section 22 forming a V-shape. Most preferably, each leg 12 and 14 may include an inwardly directed (towards the center of the body receiving space 24), convexly curved bulge 38 and 40, respectively, along the inner aspect 32 and 34 so that the body receiving space 24 forms an hourglass shape.

As seen in FIG. 2, each of the legs 12 and 14 is fillable with a compressible, resilient filler of some sort. In a preferred embodiment, the filler is a removable insert 42 that comprises a fabric enclosure 44 filled with a compressible, resilient material 46. The fabric enclosure 44 material may be any suitable fabric, including but not limited to waterproof nylon, flannel, muslin, or elastic fabrics, such as spandex or cotton-spandex blends. However, presently a polyester/cotton blend is preferred. The compressible, resilient material 46 may be solid or loose. For example, a preferred loose filler is polyester fiberfill. Other suitable fillers include down feathers, memory foam, polystyrene pellets. In some instances, the inserts 42 may comprise inflatable bladders or solid foam carved to the desired shape.

Figure 3:
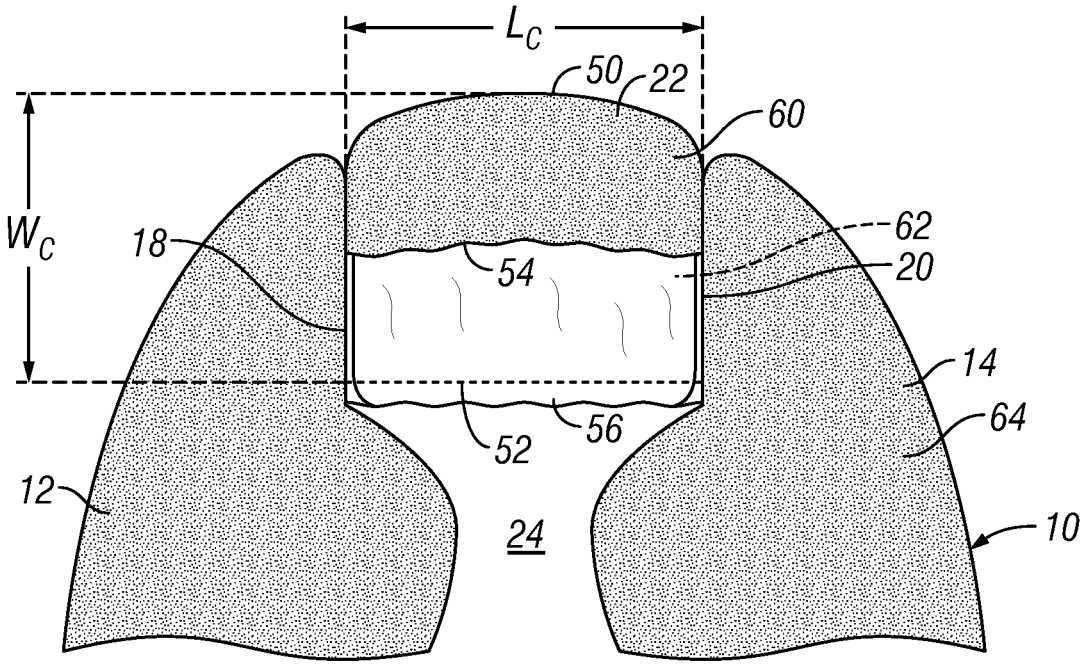
FIG. 3 is an enlarged sectional view of the first side of the upper end of the body pillow shown in FIG. 1 illustrating the shorter top panel of the pillow pocket.
Figure 4:
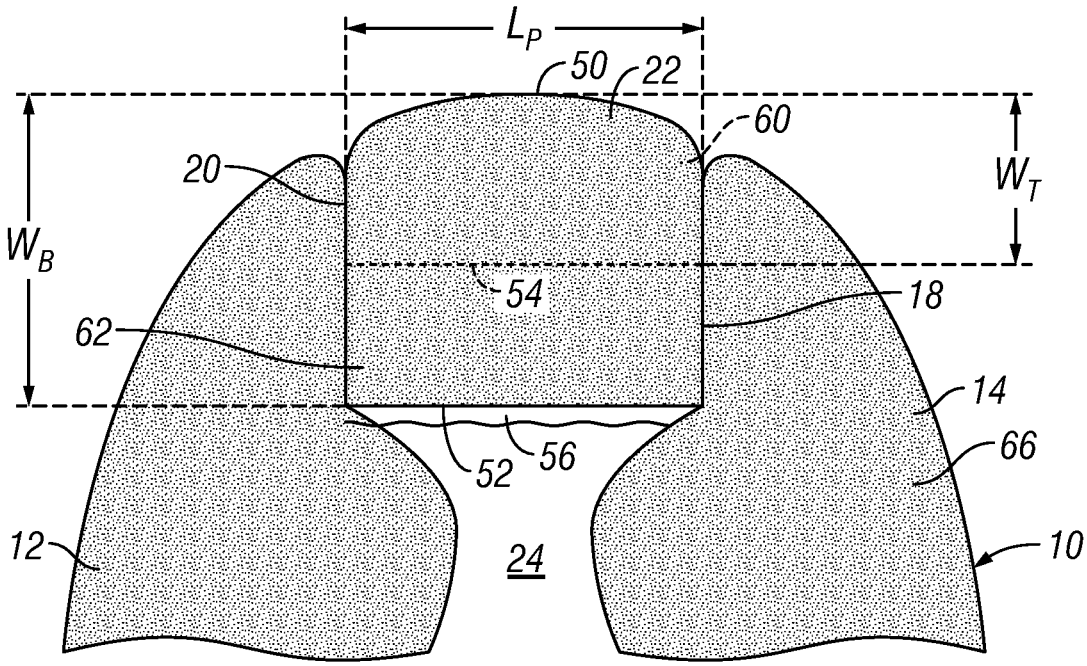
FIG. 4 is an enlarged sectional view of the second side of the upper end of the body pillow shown in FIG. 1 illustrating the full or longer bottom panel of the pillow pocket.

Referring still to FIGS. 1 and 2 and now also to FIGS. 3 and 4, the center section 22 will be described. As indicated in FIG. 3, the center section 22 has a length "$L_c$" (FIG. 3) and a width "$W_C$" bordered by the first and second ends 18 and 20, the outer perimeter 50, and the inner perimeter 52. The center section 22 defines a pillow pocket 54 sized to removably receive a bed pillow 56 and most preferably is sized to fit a bed pillow of a standardized size.

As used herein, "bed pillow" refers to a pillow used primarily to support only the head of a user when reclining, usually in bed. Commercially available bed pillows come in standardized sizes related to the size of the mattress with which they are intended to be used, namely, standard (full or double), queen, and king. Standard size is about 20 inches by about 26 inches. Queen size is about 20 inches by 30 inches, and king size is about 20 by 36 inches. Bed pillows also come in European size, which is about 26 inches square, and travel size, which is about 12 inches by 16 inches. Some pillows are made in non-standard sizes. The body pillow 10 of the present invention may be made to accommodate any size bed pillow. However, in its most preferred embodiment, the pillow pocket 54 will accommodate a standard (full or double) size pillow, as this is the most common size.

With continuing reference to FIGS. 1-4, the preferred construction for the center section 22 includes a top panel 60 and a bottom panel 62. The top panel 60 is on the top side 64 (FIG. 3) of the body pillow 10, and the bottom panel 62 is on the bottom side 66 (FIG. 4) of the body pillow. The top and bottom panels 60 and 62 preferably are configured so that when the bed pillow 56 is inserted in the pillow pocket 54 and when a user is lying in the body receiving space 24 with the user's head resting on the center section 22, a portion of the bed pillow is exposed and the user's head, neck and shoulders contact the bed pillow.

The length of the top and bottom panels 60 and 62 "$L_P$" may be the same as the length "$L_C$" of the center section 22. The width "$W_B$" of the bottom panel 62 may be about the same or slightly shorter than the width of the bed pillow 56. The width "$W_T$" of the top panel 60 preferably is substantially less than the width "$W_B$" of the bottom panel, that is, the width of the top panel is selected to expose part of the bed pillow 56. Most preferably, the width of the top panel 60 is no more than about half the width of the bottom panel 62.

Figure 5:
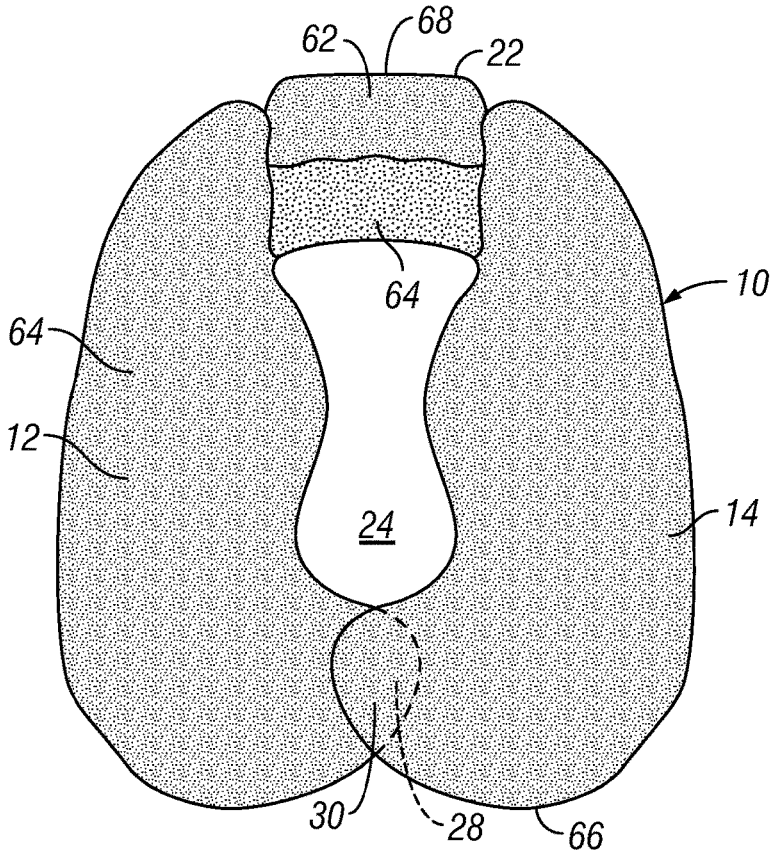
FIG. 5 is a plan view of the body pillow shown in FIG. 1 with inwardly turned toe ends slightly overlapping.

FIG. 5 illustrates one manner of positioning the bod pillow 10 in which the legs 12 and 14 are moved inwardly towards each other so that the toes 28 and 30 overlap. This provides a continuous support surface at the lower end 66 of the pillow 10 as well as at the upper end 68.

Figure 6:
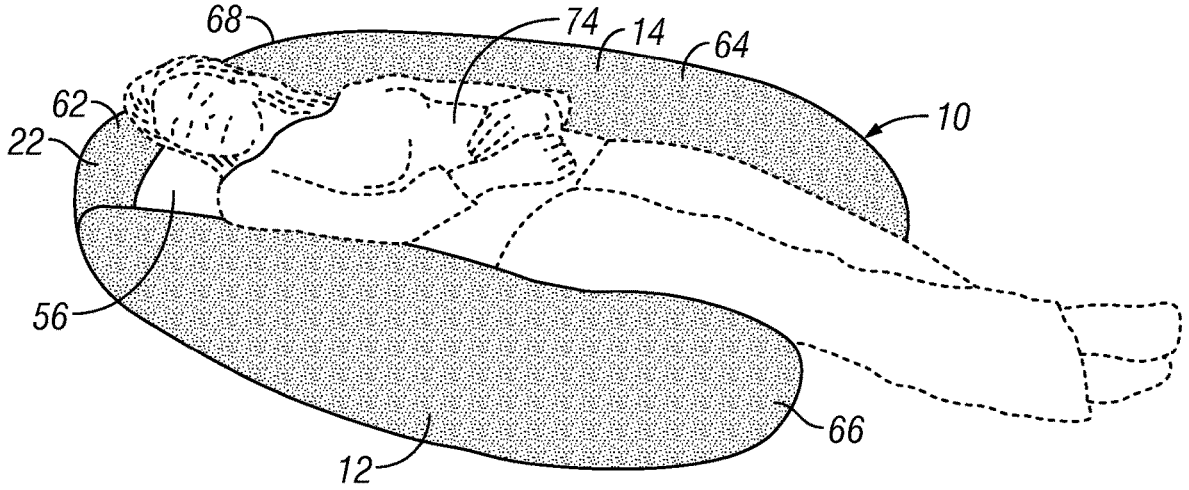
FIG. 6 is a perspective view of a user in a back lying position on the pillow resting her head on the center section.
Figure 7:
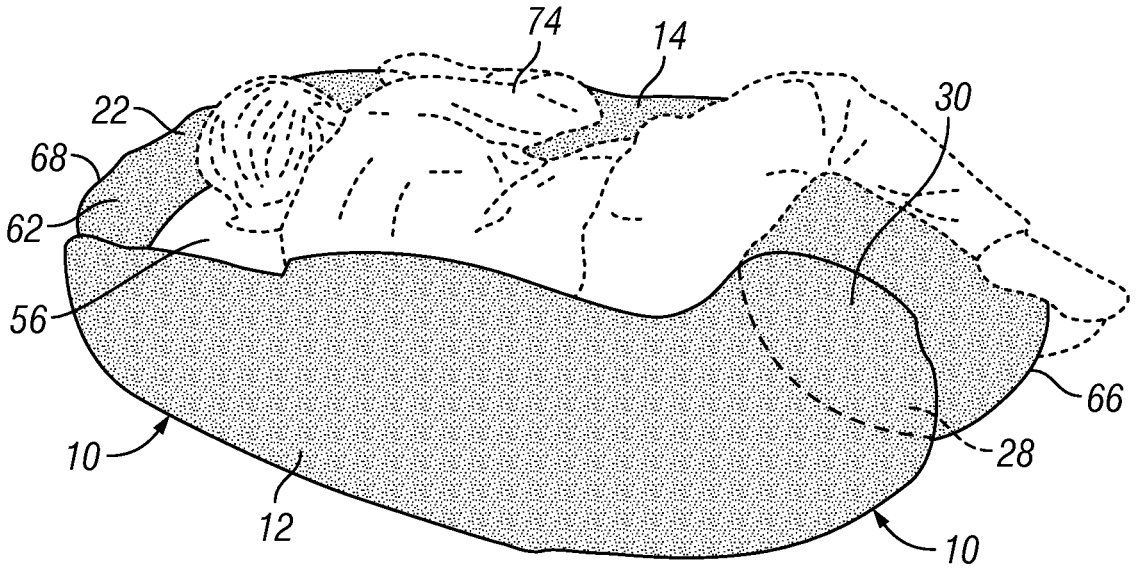
FIG. 7 is a perspective view of a user lying on her left side in the body pillow resting her head on the center section.
Figure 8:
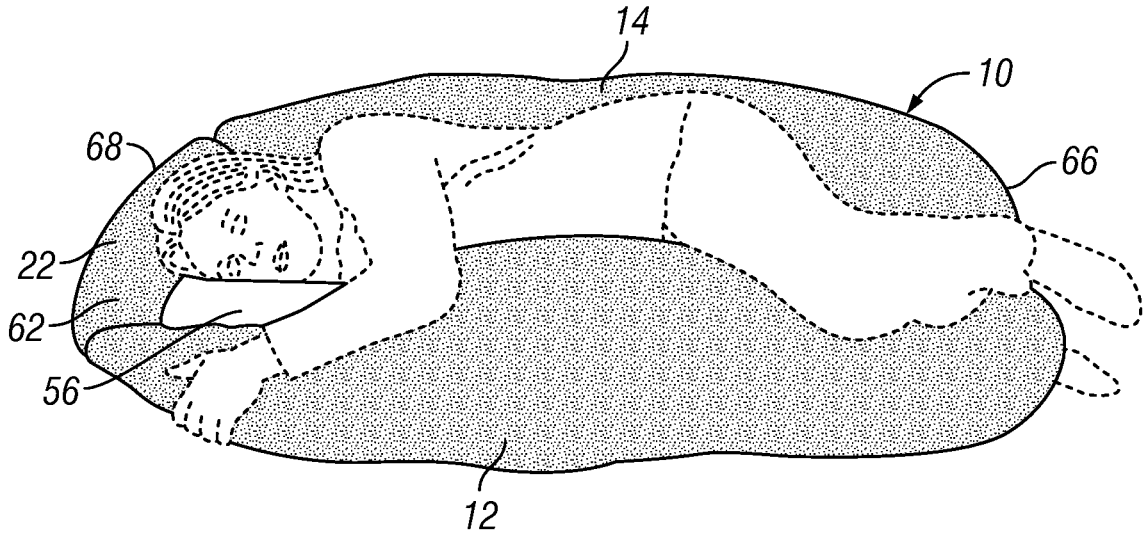
FIG. 8 is a perspective view of a user lying on her right side in the body pillow resting her head on the center section.

Shown in FIG. 6, is a user 74 in a supine position (face up) with her head resting on the upper end 68 of the body pillow 10. FIG. 7 shows the user 74 lying on her left side, and FIG. 8 shows the user lying on her right side. In both side lying positions, the overlapping toes 28 and 30 provide support for the lower legs and feet. These are only three (3) of many different possible user positions.

Now it will be apparent that the center section 22 with the pillow pocket 54 allows the user's head, neck, face (in side-lying or prone positions), and upper shoulders to contact the surface of the pillow 56. This allows the user to enjoy her preferred bed pillow and pillow case. For example, the pillow pocket 54 will accommodate gusseted style bed pillows (also called "side sleeper" bed pillows) often used by those using CPAP machines for sleep apnea. Additionally, many users prefer the feel of a conventional bed pillow under the head and neck, as the lower edge of the bed pillow is fuller and more flexible and conformable than the inner perimeter of the center section of conventional body pillows.

Thus, the body pillow 10 of the present invention provides the full body support of a fully length body pillow with the ability to use one's own preferred bed pillow and pillow case. Moreover, the pillow pocket 54 allows the bed pillow 56 to be removed easily for frequent laundering of the pillow case. This area of a conventional body pillow is likely to need to more frequent washing as it is exposed to make-up and spittle.

Of course, in some instances, a user may be using the bed pillow 56 merely for support and may prefer the feel or texture of the body pillow cover. In this case, the user may position the body pillow 10 with the top side 64 facing down and bottom side 66 facing up so that her face and neck rest mainly on the bottom panel 62, which extends to the inner perimeter 52 of the center section 22. Still further, in some instances, the user may want to rest her head on the overlapping toes 28 and 30 (FIG. 5) with her lower legs and feet on the upper end 68 of the pillow 10. This is another case in which the user may prefer to lie on the bottom side 66 of the pillow 10.

The body pillow 10 preferably is formed of a soft, pliable, and washable fabric. It can be made by cutting two identical blanks of fabric in the desired size and shape and then stitching the edges together in a known manner. It will be advantageous in most instances to provide an opening in each leg 12 and 14 for removing the leg pillow inserts 42 (FIG. 2). This opening (not shown) may be provided with a closure such as a zipper of hook-and-loop fabric.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A body pillow for use with a standard sized bed pillow, the body pillow comprising:

a center section having first and second ends, and wherein the center section defines a pillow pocket sized to removably receive the standard sized bed pillow;

a first leg extending at an angle from the first end of the center section; and a second leg extending at an angle from the second end of the center section;

wherein the first and second legs are fillable with compressible, resilient material;

wherein when the first and second legs are filled with the compressible, resilient material and when the bed pillow is received in the pillow pocket, the compressible, resilient material in the first and second legs is separate from the bed pillow;

wherein, in the resting position, the center section and the first and second legs together form a body receiving space that includes a generally U-shaped portion; and wherein the pillow pocket is shaped so that, when the bed pillow is inserted in the pillow pocket and when a user is lying in the body receiving space with the user's head resting on the center section, a portion of the bed pillow is exposed and the user's head, neck and shoulders contact the bed pillow.

2. The body pillow of claim 1 wherein the pillow pocket is formed by a top panel having a width and a bottom panel having a width and wherein the top panel of the center section is no more than about half the width of the bottom panel.

3. The body pillow of claim 1 wherein the first and second legs are the same length.

4. The body pillow of claim 1 wherein the first and second legs extend divergently from the center section forming a V-shape.

5. The body pillow of claim 1 wherein the first and second legs are formed symmetrically.

6. The body pillow of claim 1 wherein each of the first and second legs terminates in an inwardly turned toe.

7. The body pillow of claim 6 wherein each of the first and second legs has a length and defines an inner aspect forming part of the body receiving space, and wherein each of the legs includes an inwardly protruding convex bulge along the inner aspect so that the body receiving space forms an hourglass shape.

8. The body pillow of claim 1 wherein each of the first and second legs has a length and defines an inner aspect forming part of the body receiving space, and wherein each of the legs includes an inwardly protruding convex bulge along the inner aspect so that the body receiving space forms an hourglass shape.

9. The body pillow of claim 1 further comprising a standard sized bed pillow removably receivable in the pillow pocket.

10. The body pillow of claim 1 wherein the compressible, resilient material in the first and second legs is removable.

11. The body pillow of claim 10 further comprising compressible, resilient material sized to fill the first and second legs.

12. The body pillow of claim 11 wherein the compressible, resilient material is contained in a fabric enclosure.

13. The body pillow of claim 12 further comprising a standard sized bed pillow removably receivable in the pillow pocket.

14. The body pillow of claim 13 wherein the first and second legs are symmetrically formed and of equal lengths.

15. A cover for a body pillow, wherein the body pillow is for use with a standard sized bed pillow, and wherein the body pillow cover comprises:

a center section having first and second ends, and wherein the center section defines a pillow pocket sized to removably receive the standard sized bed pillow;

a first leg extending at an angle from the first end of the center section; and a second leg extending at an angle from the second end of the center section;

wherein the first and second legs are fillable with compressible, resilient material;

wherein when the first and second legs are filled with the compressible, resilient material and when the bed pillow is received in the pillow pocket, the compressible, resilient material in the first and second legs is separate from the bed pillow;

wherein, in the resting position, the center section and the first and second legs together form a body receiving space that includes a generally U-shaped portion; and wherein the pillow pocket is shaped so that, when the bed pillow is inserted in the pillow pocket and when a user is lying in the body receiving space with the user's head resting on the center section, a portion of the bed pillow is exposed and the user's head, neck and shoulders contact the bed pillow.

16. The body pillow cover of claim 15 wherein the pillow pocket is formed by a top panel having a width and a bottom panel having a width and wherein the top panel of the center section is no more than about half the width of the bottom panel.

17. The body pillow cover of claim 15 further comprising compressible, resilient material in the first and second legs.

18. The body pillow cover of claim 15 wherein the first and second legs are the same length.

19. The body pillow cover of claim 15 wherein the first and second legs extend divergently from the center section forming a V-shape.

20. The body pillow cover of claim 15 wherein the first and second legs are formed symmetrically.

21. The body pillow cover of claim 15 wherein each of the first and second legs terminates in an inwardly turned toe.

22. The body pillow cover of claim 21 wherein each of the first and second legs has a length and defines an inner aspect forming part of the body receiving space, and wherein each of the legs includes an inwardly protruding convex bulge along the inner aspect so that the body receiving space forms an hourglass shape.

23. The body pillow cover of claim 15 wherein each of the first and second legs has a length and defines an inner aspect forming part of the body receiving space, and wherein each of the legs includes an inwardly protruding convex bulge along the inner aspect so that the body receiving space forms an hourglass shape.

24. The body pillow cover of claim 15 further comprising a standard sized bed pillow removably receivable in the pillow pocket.

25. The body pillow cover of claim 17 wherein the compressible, resilient material in the first and second legs is removable.

26. The body pillow cover of claim 25 wherein the compressible, resilient material is contained in a fabric enclosure.

27. The body pillow cover of claim 26 further comprising a bed pillow removably receivable in the pillow pocket.

28. The body pillow cover of claim 27 wherein the first and second legs are symmetrically formed and of equal lengths.

29. A body pillow for use with a standard sized bed pillow, the body pillow comprising:

a center section having first and second ends, and wherein the center section defines a pillow pocket sized to removably receive the standard sized bed pillow;

a first leg extending at an angle from the first end of the center section; and a second leg extending at an angle from the second end of the center section;

wherein the first and second legs are fillable with compressible, resilient material;

wherein when the first and second legs are filled with the compressible, resilient material and when the bed pillow is received in the pillow pocket, the compressible, resilient material in the first and second legs is separate from the bed pillow;

wherein, in the resting position, the center section and the first and second legs together form a body receiving space that includes a generally U-shaped portion; and wherein the pillow pocket is formed by a top panel having a width and a bottom panel having a width and wherein the top panel of the center section is no more than about half the width of the bottom panel.

30. A cover for a body pillow, wherein the body pillow is for use with a standard sized bed pillow, and wherein the body pillow cover comprises:

a center section having first and second ends, and wherein the center section defines a pillow pocket sized to removably receive the standard sized bed pillow;

a first leg extending at an angle from the first end of the center section; and a second leg extending at an angle from the second end of the center section;

wherein the first and second legs are fillable with compressible, resilient material;

wherein when the first and second legs are filled with the compressible, resilient material and when the bed pillow is received in the pillow pocket, the compressible, resilient material in the first and second legs is separate from the bed pillow;

wherein, in the resting position, the center section and the first and second legs together form a body receiving space that includes a generally U-shaped portion; and wherein the pillow pocket is formed by a top panel having a width and a bottom panel having a width and wherein the top panel of the center section is no more than about half the width of the bottom panel.

* * * * *